US006945913B2

(12) United States Patent
Moore et al.

(10) Patent No.: US 6,945,913 B2
(45) Date of Patent: Sep. 20, 2005

(54) CUSHIONED PIVOTING DECK

(75) Inventors: Steve Moore, Seattle, WA (US); Thomas Moran, Seattle, WA (US)

(73) Assignee: Precor Incorporated, Woodinville, WA (US)

( * ) Notice: Subject to any disclaimer, the term of this patent is extended or adjusted under 35 U.S.C. 154(b) by 29 days.

(21) Appl. No.: 10/420,984

(22) Filed: Apr. 21, 2003

(65) Prior Publication Data

US 2003/0195087 A1 Oct. 16, 2003

Related U.S. Application Data

(62) Division of application No. 09/481,059, filed on Jan. 11, 2000, now Pat. No. 6,572,513, which is a division of application No. 08/825,513, filed on Mar. 31, 1997, now Pat. No. 6,013,011.

(51) Int. Cl.[7] ..... A63B 22/02
(52) U.S. Cl. ..... 482/54; 482/51; 482/6
(58) Field of Search ..... 482/51–54, 77, 482/71, 101, 6

(56) References Cited

U.S. PATENT DOCUMENTS

| | | | | |
|---|---|---|---|---|
| 4,344,616 A | | 8/1982 | Ogden | |
| 4,350,336 A | | 9/1982 | Hanford | |
| 4,423,864 A | | 1/1984 | Wiik | |
| 4,974,831 A | | 12/1990 | Dunham | |
| 4,984,810 A | | 1/1991 | Stearns et al. | |
| 5,184,988 A | | 2/1993 | Dunham | |
| 5,279,528 A | * | 1/1994 | Dalebout et al. | 482/54 |
| 5,336,144 A | | 8/1994 | Rodden | |
| 5,382,207 A | | 1/1995 | Skowronski et al. | |
| 5,441,468 A | | 8/1995 | Deckers et al. | |
| 5,454,772 A | * | 10/1995 | Rodden | 482/54 |
| 5,476,430 A | | 12/1995 | Lee et al. | |
| 5,484,362 A | | 1/1996 | Skowronski et al. | |
| 5,562,575 A | | 10/1996 | Gvoich | |
| 5,599,259 A | | 2/1997 | Skowronski et al. | |
| 5,868,648 A | * | 2/1999 | Coody et al. | 482/54 |
| 6,013,011 A | * | 1/2000 | Moore et al. | 482/54 |
| 6,572,513 B1 | * | 6/2003 | Whan-Tong et al. | 482/54 |

FOREIGN PATENT DOCUMENTS

| | | |
|---|---|---|
| DE | 3601-184 | 1/1986 |
| FR | 2616132 | 12/1988 |
| SU | 1395344 | 5/1988 |
| WO | WO81/01960 | 7/1981 |
| WO | WO 97/21471 | 6/1997 |

* cited by examiner

*Primary Examiner*—Jerome W. Donnelly
(74) *Attorney, Agent, or Firm*—Christensen O'Connor; Terence P. O'Brien; Paul Schaafsma

(57) ABSTRACT

A treadmill (10) includes a frame on which are mounted transverse forward and rearward roller assemblies (14, 16). An endless belt (18) is trained about the forward and rearward roller assemblies. A deck (20) is positioned between the upper run of the belt and the frame. The rearward portion of the deck (20) is mounted to the frame by a pivot connection (24) to allow pivoting of the deck about an axis transversely to the length of the deck. Elongate springs (26) of adjustable stiffness are mounted either along the sides of the frame to underlie the side margins of the deck, or transversely of the deck, to support the deck in conjunction with the pivot connection (24) and to absorb impact loads imparted on the deck by the user.

37 Claims, 6 Drawing Sheets

CUSHIONED PIVOTING DECK

CROSS-REFERENCE TO RELATED APPLICATIONS

This application is a divisional of application Ser. No. 09/481,059, filed Jan. 11, 2000 U.S. Pat. No. 6,572,513, which is a divisional of application Ser. No. 08/825,513, filed Mar. 31, 1997, now U.S. Pat. No. 6,013,011, priority from the filing date of which is hereby claimed under 35 U.S.C. § 120.

FIELD OF THE INVENTION

The present invention relates to exercise equipment, and more particularly to exercise treadmills, and still more particularly to suspension systems for supporting the deck of the exercise treadmill above an underlying frame structure.

BACKGROUND OF THE INVENTION

Exercise treadmills are widely used in spas, exercise clubs and also in individual residences to enable users to walk, jog or run indoors. This is especially useful during inclement weather and also at night or at other times when exercisers do not desire to run outdoors. Most exercise treadmills include first and second roller assemblies that are transversely mounted at the ends of a frame. An endless belt is trained about the roller assemblies. The upper run of the belt is supported by an underlying deck positioned between the belt and the frame.

Efforts have been made to reduce the impact on the user's limbs and joints when jogging or running on a treadmill. One method of reducing the impact on an exerciser's body is disclosed by U.S. Pat. Nos. 4,974,831 and 4,984,810. In the treadmills disclosed by these patents, the rear end of the deck is pivotally mounted to the frame, with the forward end of the deck supported by a suspension system. In the '831 patent, the suspension system consists of a fairly complicated lever arm assembly and cooperating shock absorbers. Striding on a deck results in pivoting of the lever arms and extension of the shock absorbers, thereby to dampen the impact of the user's feet. A drawback of this shock absorption system is its complex nature, rendering it costly to manufacture.

In the '810 patent, the forward end of the treadmill deck was supported by a conventional compression spring and separate shock absorber. Placement of the spring and shock absorber at the very front of the deck imposes considerable bending stress on the deck.

Other conventional treadmills have utilized rubber blocks positioned between the deck and the underlying frame to absorb impact. One such conventional treadmill is disclosed in French Patent No. 2,616,132. A treadmill deck is mounted above the frame members on a plurality of flexible pads. Bushings are inserted into the top and bottom of each pad, and bolts depending downwardly from the deck and upwardly from frame are received within the corresponding bushings. The bolts serve to position the flexible pads between the deck and frame for shock absorption.

U.S. Pat. Nos. 5,336,144 and 5,454,772 disclose a deck supported above a frame by a plurality of cup-shaped elastomeric springs. The elastomeric springs reversibly deform during downward deflection of the deck toward the frame. The elastomeric springs have side walls of tapering thickness. As a result, the resistance to the downward travel of the deck provided by the elastomeric springs is proportional to the degree of deflection of the deck toward the frame. One drawback of this particular treadmill construction is that the elastomeric springs are fixed in place and individually define a rather small bearing area.

SUMMARY OF THE INVENTION

The present invention provides an exercise treadmill having a frame, first and second roller assemblies rotatably mounted on the frame, and an endless belt trained about the first and second roller assemblies. The exercise treadmill also includes a deck disposed between the frame and the upper run of the belt. A pivot connection pivotally connects the rearward end portion of the deck to the frame. Elongate elastomeric spring members are disposed between the frame and the deck at a location intermediate the ends of the deck to support the deck spaced above the frame. The elastomeric springs reversibly deform to resist a deflection (downward movement) of the deck toward the frame when the exerciser strides on the endless belt. The resistance provided by the elastomeric spring members is proportional to the extent of deflection of the deck.

In a further aspect of the present invention, the elastomeric spring members are mounted on the side rails of the frame and underlie marginal side portions of the deck.

In another aspect of the present invention, the elastomeric springs include a base portion and a bulbous body portion extending upwardly from the base portion. The body portion is domed or crowned at its top to define an outwardly convex shape. The interior of the elastomeric spring between the base portion and the body portion is hollow or partially hollow. As a result, the body portion deflects downwardly under the force imposed on the deck by the exerciser.

In an additional aspect of the present invention, the wall thickness of the body portion of the elastomeric spring is greater at the intersection of the body portion with the base of the elastomeric spring. The wall thickness of the body portion decreases in the direction away from the base portion, reaching a minimum thickness at the top of the domed body portion. As a result, when the deck imparts a downward load on the elastomeric springs, the top central portion of the body portion of the elastomeric spring deflects downwardly into the hollow interior, rather than the body portion deflecting sideways, which could occur if the elastomeric spring was of solid construction. Also, the resistance imposed on the deck by the elastomeric spring increases as the deck deflects downwardly, thereby providing a variable rate spring.

In another aspect of the present invention, the spring may be constructed so that its rate of deformation may be selectively altered. In this regard, a compressible insert is sized and shaped to be selectively insertable to a desired degree into the hollow body portion of the spring. In cross-section, the insert may correspond to the cross-sectional shape of the hollow body portion of the spring. Also, the spring may be tapered along its length. In another configuration, the body portion of the spring may be adapted to receive a compressible fluid thereby serving as a bladder. In a more specific aspect of the present invention, the compressible fluid may be composed of air, with the air being supplied to the bladder by an air pump. Also in a more specific aspect of the present invention, a valve or other means may be provided for discharging the compressible fluid from the bladder.

In a further aspect of the present invention, the pivot connection at the rearward end of the deck includes a spindle mounted on the frame side member to engage with a hinge bracket mounted to the underside of the deck. By this construction, the rearward end portion of the deck is pivotally attached to the frame about an axis extending transversely to the length of the deck.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
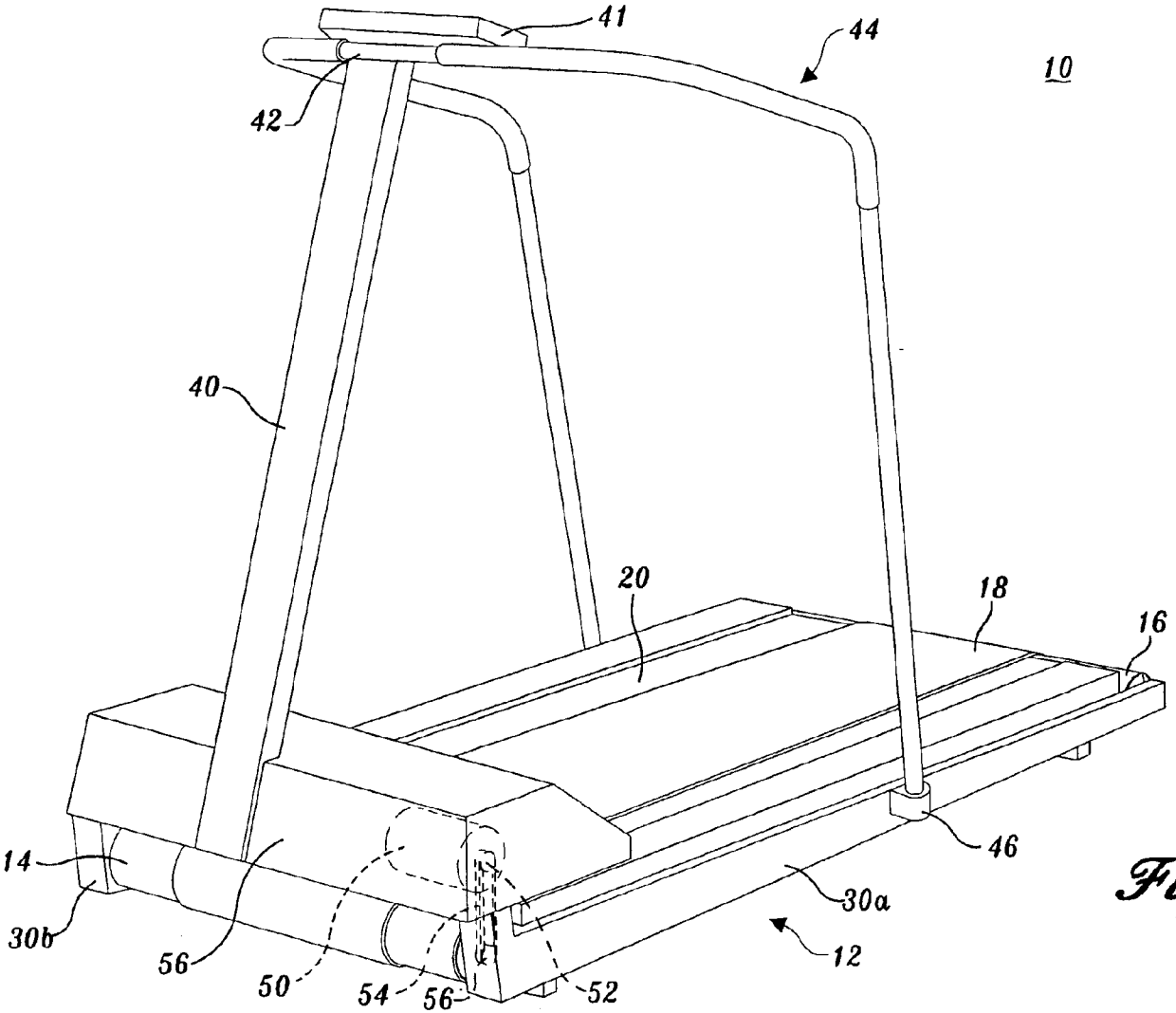
FIG. 1 is a pictorial view of an exercise treadmill constructed in accordance with the present invention.
Figure 2:
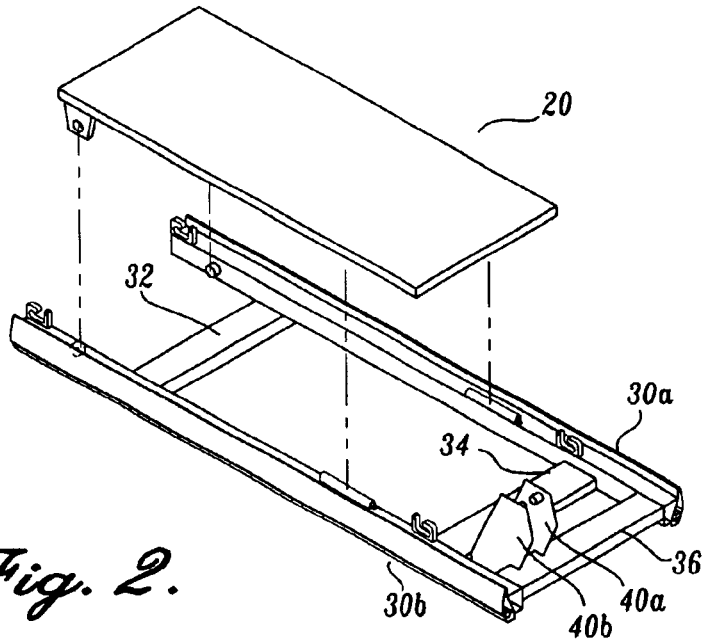
FIG. 2 is an exploded pictorial view of the frame, deck, pivot connection and elastomeric springs of the exercise treadmill of FIG. 1.
Figure 3:
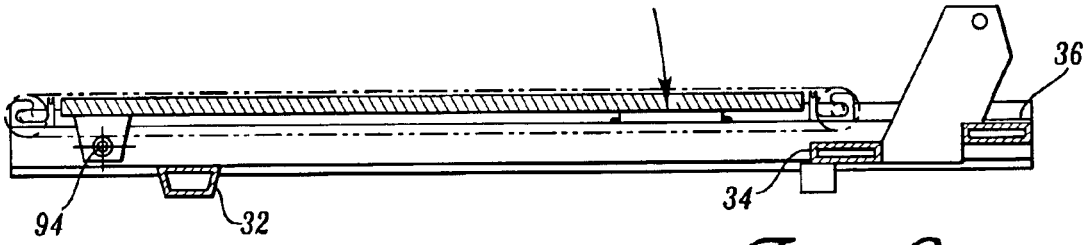
FIG. 3 is a partial cross-sectional view of the exercise treadmill shown in FIG. 1 taken substantially along lines 3—3 thereof.
Figure 5:
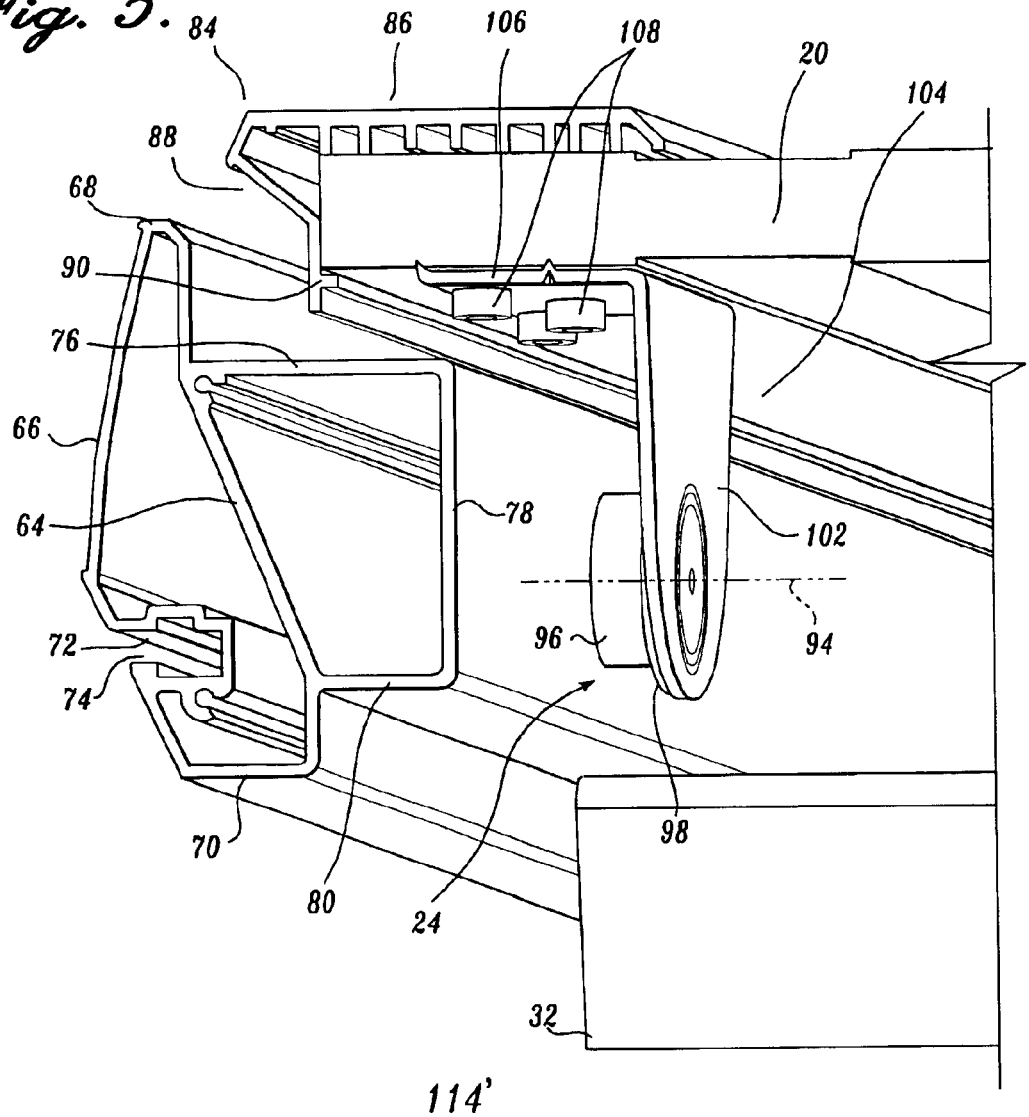
FIG. 5 is a further enlarged fragmentary pictorial view of the exercise treadmill of the present invention, specifically illustrating the pivot connection between the deck and the frame.

Initially referring to FIG. 1, a treadmill 10 constructed in accordance with the present invention includes a frame 12 on which is mounted a forward roller assembly 14 and a rearward roller assembly 16 are transversely mounted to the frame. For purposes of the present application, including the claims therein, the designation "forward end" refers to the direction in which the exerciser faces when using the treadmill. The terms "rear" and "forward" refer to opposite directions. An endless belt 18 is trained about the forward and rearward roller assemblies 14 and 16. A deck 20 is positioned between the upper run of the belt 18 and the frame 12. Referring additionally to FIGS. 2, 3 and 5, the rearward portion of the deck 20 is pivotally mounted to the frame by a pivot connection 24 to allow the rearward portion of the deck to pivot transversely to the frame about an axis extending relative to the length of the deck. Elongate, deformable springs 26 are mounted on the frame to underlie side margins of the deck to support the deck in conjunction with the pivot connection 24.

Describing the foregoing aspects of the present invention in greater detail, the frame 12 includes a pair of longitudinal, formed side rails 30A and 30B that are disposed in laterally spaced apart, parallel relationship to each other by a rearward cross member 32, an intermediate cross member 34 and a forward cross member 36. Ideally, the cross members are formed from hollow metal extrusions so as to provide a high strength to weight ratio. Brackets 38 are positioned on the frame side rails 30A and 30B to engage the ends of the roller assemblies 14 and 16; see FIGS. 2 and 3.

The frame 12 also includes a pair of planar mounting plates 40A and 40B that extend upwardly from a position between the intermediate and forward cross members 34 and 36 to support an upwardly extending post 40. The post 40 extends upwardly and forwardly from the forward end of the frame 12 to support the transverse section 42 of railing 44. The railing 44 extends rearwardly and slightly downwardly from transverse section 42 and thereafter extends primarily downwardly to terminate at lower ends that are secured to the frame by attachment brackets 46. The railing is manually graspable by the exerciser during walking, jogging or running on the treadmill 10.

The post 40 also supports a display panel 41 that displays various information during use of the treadmill, including speed of the belt, duration of the exercise, calories being burned, the course being run by the exerciser, etc. The display panel typically also includes various control knobs or buttons, for example, a start button, a speed control, an emergency shut off, etc.

The treadmill 10 further includes a motor 50 having a drive shaft 52 engaged by a drive belt 54 mounted on one end of forward roller assembly 14. The motor 50 rotatably drives the forward roller assembly 14 thus causing movement of the treadmill belt 18 on which an exerciser strides during use of the treadmill 10. The motor 50 is located within a formed housing cover 56 extending transversally across the forward end of the treadmill.

Figure 4:
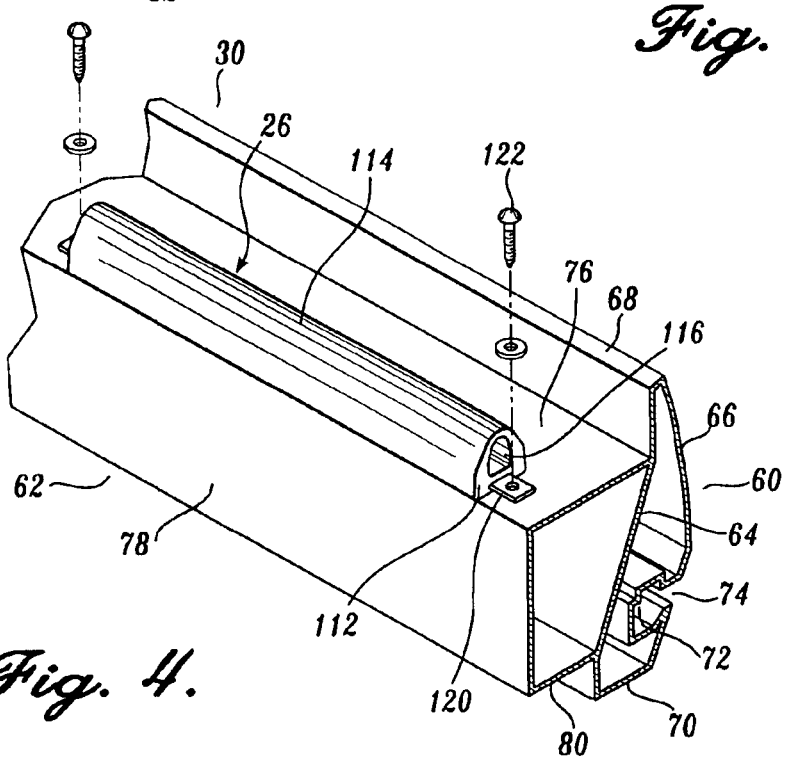
FIG. 4 is an enlarged fragmentary pictorial view of a portion of the frame of the exercise treadmill in the location of an elastomeric spring.

Next referring primarily to FIGS. 2–4, the side rails 30A and 30B are constructed as mirror images of each and thus the same part numbers will be used for the components of the side rails with the understanding that such part numbers refer to a corresponding components of the side rails. As shown most clearly in FIG. 4, the side rails 30A and 30B are composed of multi-cavity metal extrusions having an outward section 60 and an inward section 62 which share a common generally upright extending wall 64. In cross section, both the outward section 60 and the inward section 62 are constructed as closed box sections with the configuration of the outward section being somewhat more complicated than the inward section. In this regard, the outward section 60 includes a curved, outwardly convex, outer wall 66 extending downwardly from an upper lip 68 to a bottom horizontal wall 70. Between the upper lip 68 and the bottom wall 70, the outer wall defines an inwardly extending slot 72 having an entrance section 74 somewhat narrower than the height of the slot proper. Slot 72 is sized to slidably receive a corresponding shaped inward key portion (not shown) of bracket 46 which secures the lower ends of the railing 44 to the frame side rails.

Still referring specifically to FIG. 4, the side rail inward section 62 includes a substantially horizontal upper wall 76, a substantially vertical inward wall 78 and a substantially horizontal bottom wall 80, which cooperate with common wall 64 to define a closed, substantially rectangular, box-like cross section. As shown in FIG. 3, the rear cross member 32 bears against the bottom of the bottom wall 80. In addition, the lower edge of the intermediate cross member 34 is substantially flush with bottom wall 80, and the upper surface of the forward cross member 36 is substantially flush with the top wall 76. Moreover, as shown most clearly in FIGS. 2 and 3, the brackets 38 used for mounting the forward and rearward roller assemblies 14 and 16 are positioned on the top wall 76, which top wall functions as a shoulder member. Further, as will be discussed more fully below, of the elongate elastomeric springs 26 are also mounted on the top wall 76. It will be appreciated that the side rails 30A and 30B can be constructed differently than shown in the drawings and described above without departing from the spirit of scope of the present invention.

Referring primarily to FIGS. 2 and 3, the deck 20 is formed as a flat, rectangular, substantially rigid panel having smooth upper and lower surfaces. Suitable materials for forming the deck 20 include plywood or other reinforced wood structures, reinforced thermal set plastic materials, metal and other substantially rigid materials. Ideally the stiffness of the deck as defined by its EI (Modulus of Elasticity ($lb/in^2$)×Moment of Inertia ($in^4$)) is from about $0.5\times10^6$ to $2.0\times10^6$ lb. $in^2$. Preferably at least the upper surface of the deck is coated with or imbedded with a low friction coating, for instance, a wax composition.

As illustrated in FIG. 5, a formed trim strip 84 is mounted on each side margin of the deck 20 to protect the edge portions of the deck as well as to laterally constrain the belt 20. The trim strip 84 includes a top section 86 overlapping the top side margins of the deck, a side section 88 bearing against the side edges of the deck and a lower shoulder 90 overlapping the bottom side edge of the deck. Ideally, the trim strip 84 is formed from an extruded metallic or plastic material.

Still referring specifically to FIG. 5, pivot connection 24 includes two hinge assemblies, one at each side of the rearward portion of the deck, for mounting the deck rearward end portion to the frame side rail inward section 62 so as to pivot about a transverse axis 94. More specifically, each hinge assembly includes a mounting spindle 96 affixed to the inward surface of frame wall 78. A flange bearing 98 is mounted on a reduced diameter shoulder formed in the distal portion of spindle 96, with the web portion of the flange bearing closely fitting within a circular opening formed in the lower section of the vertical leg 102 of hinge bracket 104. The hinge bracket 104 includes an upper horizontal mounting plate portion 106 having clearance openings formed therein for receiving threaded fasteners that extend downwardly through the deck to engage hardware members 108 beneath plate 106.

It will be appreciated that other methods may be utilized to pivotally attach the rearward portion of the deck 20 to the frame 12. For example, a piano hinge, not shown, could be mounted to the underside of the deck 20 and to a frame cross member, not shown.

Next referring specifically to FIG. 4, the spring 26 is illustrated as being of a generally "d" cross-sectional shape. The spring 26 includes a base portion 112 that lies on top of frame top wall 76, and a bulbous, upwardly projecting, crowned or domed body section 114 that extends upwardly from the base portion to bear against the underside of the side margins of deck 20, see also FIGS. 2 and 3. The interior 116 of the spring 26 preferably is hollow or substantially hollow, to allow the downward deformation of the body section 114. Ideally, the body section 114 is not formed of a uniform wall thickness, rather the wall thickness decreases in the direction away from base portion 112, so that at the domed top of the body section 114 the wall thickness is approximately ⅓ to ½ the thickness of the body section at the intersection thereof with the base section 112.

The characteristics of spring 26 may also be altered by changing its cross-sectional dimensions. It is to be understood that the overall cross-sectional dimensions and size of the spring 26 may be increased to provide a stiffer spring or decreased to provide a less stiff spring. Also, the wall thickness at various positions about the cross section of the body section may be altered to change the characteristics of the spring.

In one preferred embodiment of the present invention, the width of the spring is approximately 1.0 to 1.5 inches wide, and the thickness of the base portion 112 is approximately 0.2 to 0.4 inches thick. Also the overall height of the spring is approximately 1 to 1.25 inches high. In addition, the wall thickness of the body section at its intersection with the base may be from 0.3 to 0.4 inches thick, and decreasing in thickness to approximately 0.1 to 0.2 inches at the top of the body section. It is to be understood that the foregoing dimensions were illustrative of a preferred embodiment of the present invention and are not considered to be restrictive of the scope of the present invention.

Ideally, the spring 26 is composed of an elastomeric material, such as a natural or synthetic rubber compound. It would be appreciated that the hardness of the rubber can be altered to thereby alter the spring rate and other characteristics of the spring 26. The spring 26 may be formed in selective lengths depending on the level of resistance to downward deformation of the spring desired.

Also, the spring 26 may be placed at a selected position along the length of the side rails 30A and 30B to achieve the desired the manner in which deck 26 reacts to impact loads imposed thereon by the exerciser. Ideally, the spring 26 is placed at the location along the side rails coinciding to where the exerciser's foot strikes the belt 18 above the deck 20.

The spring 26 is held in position by an elongate strap 120 that extends through a longitudinal slot formed in the base portion 112 of the spring. The ends of the strap 120 extend beyond the ends of the elastomeric spring to provide mounting tabs having clearance holes formed therein for receiving a threaded fastener extending downwardly through the tab and into the interior of frame rail wall 76. Other methods may be provided for securing the spring 26 to the frame rail.

Also, as noted above, the springs 26 may be selectively placed along the length of the frame rail to alter the energy absorbing and cushioning effects provided by the elastomeric spring. This may be accomplished by simply loosening the threaded fasteners 122 and re-engaging them within wall 76 at a different location along the frame rail.

Although the spring 26' is illustrated as mounted on the frame side rail, it could be instead mounted to the underside of deck 20, for instance, by engaging the threaded hardware member 122 upwardly into the underside of the deck 20.

Figure 6:
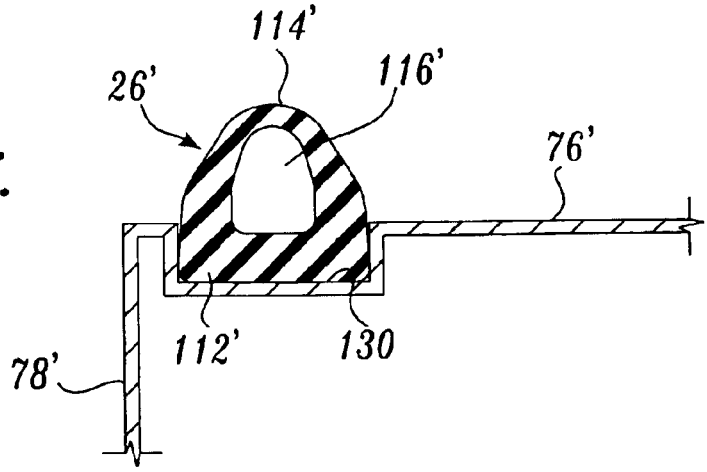
FIG. 6 is an enlarged partial cross-sectional view of an alternative embodiment of the present invention.

Spring 26 may be adapted to slide along the frame rail. This may be accomplished, for instance, by configuring the upper wall 76' of the frame rail to define an upwardly open channel 130 for receiving the spring 26' shown in FIG. 6. In FIG. 6 the components of the present invention are numbered to correspond to like components in the embodiment of the present invention shown in FIGS. 1–5, but with the addition of the prime "'" designation. Any convenient method may be used to retain the spring 26' stationary with channel 130 in the lengthwise direction.

When the treadmill 10 of the present invention is in use, as the exerciser's foot lands on belt 18, the treadmill deck is deflected (moves) downwardly toward frame 12. This deflection is resisted by compression of the springs 26. The springs 26 act to absorb the shock of the impact of the exerciser's feet. Because the treadmill deck is pivotally mounted at its rearward end and otherwise supported only by the springs, the treadmill deck 20 is free to move (pivot) up and down relative to the treadmill frame 20. Downward deflection of the deck 20 towards the frame 12 results in a reversible compression of the springs 26. In particular, the top central section of the spring body section 114 initially deflects centrally downwardly due to this portion of the bulbous section being thinner than at the intersection of the spring base portion 112. However, as the deck 20 continues to travel downwardly toward frame 12, increasingly thicker sections of the body section 14 must be compressed or deformed. The springs 26 thus become increasingly "stiffer" with further compression, offering a degree of resistance to the downward movement of the deck 20 that increases in proportion to the extent of travel of the deck 20.

Moreover, the body section 114 of the elastomeric spring is thinnest at the top of the body section. As a result, the body section 114 deflects centrally downwardly rather than tending to deflect sideways as it deforms, which in turn would place a lateral load on the deck 20. This tendency to deflect laterally or sideways is not present by virtue of constructing the body section 114 with an increasingly thinner wall section in a direction from base 112 to the top or crown of the bulbous section.

Because the degree of resistance to the downward movement of the deck 20 provided by springs 26 is proportional to the extent of the deflection or downward movement of the deck, the treadmill 10 provides a suitable shock absorption for exercisers of varied weights. Individuals who are lighter in weight do not impart as great an impact force on the treadmill deck during foot fall. Nevertheless, the treadmill deck 20 deflects downward toward the treadmill frame because of the relatively "easy" initial compression of the springs 26', thereby providing suitable shock absorption for lighter weight individuals. When individuals of greater weight use treadmill 10, greater impact loads are imparted to the treadmill deck 20, which loads are met with proportionally greater resistance by the springs 26 because of the proportionally greater downward deflection of the deck 20.

Figure 7:
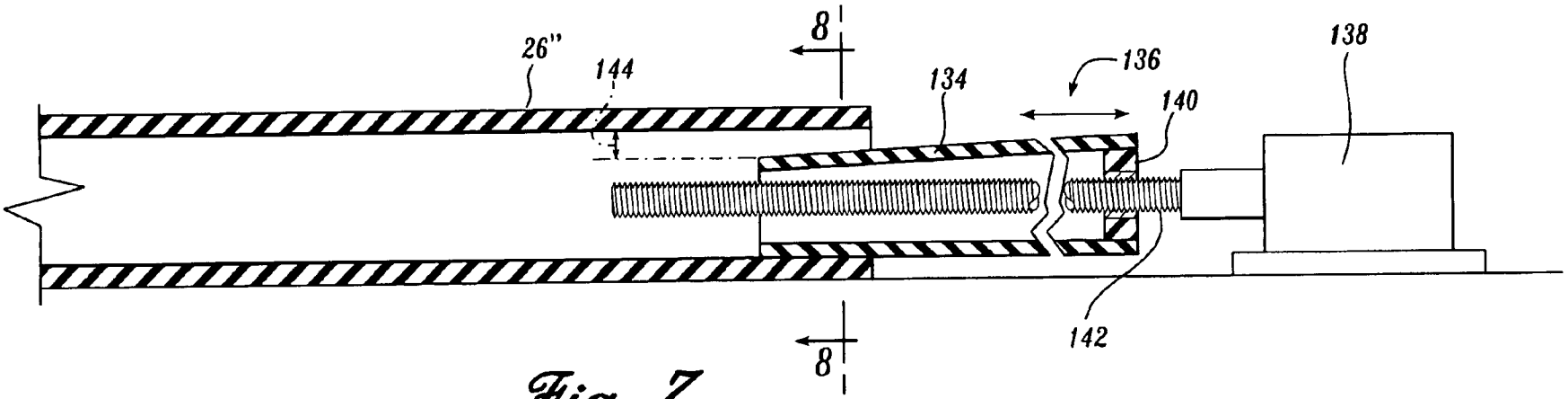
FIG. 7 is an enlarged elevational schematic view of another preferred embodiment of the present invention
Figure 8:
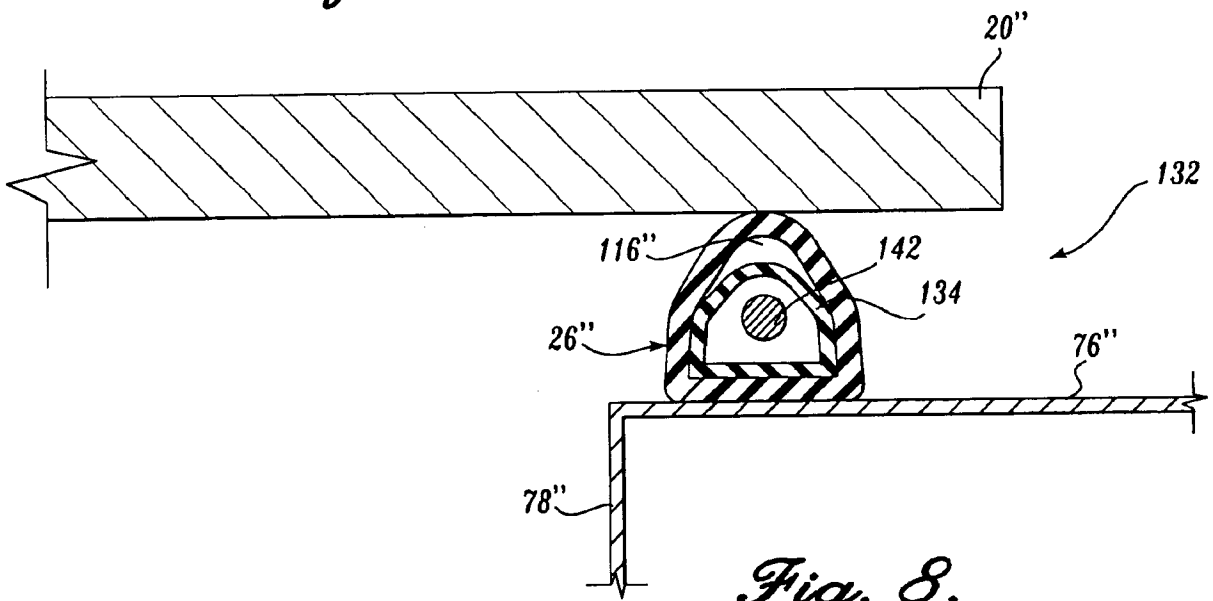
FIG. 8 is a cross-sectional view of the embodiment shown in FIG. 7 taken substantially along lines 8—8 thereof.

The embodiment of the present invention shown in FIGS. 7 and 8 pertains to a spring assembly 132 composed of a bulbous or hollow spring 26" that may be constructed similarly to springs 26 and 26' described above. The spring assembly 132 also includes an insert member 134 shaped and sized to be receivable within the hollow interior 116" of spring 26". Preferably, but not mandatorily, the exterior shape of insert 134 generally corresponds to the interior shape of the hollow interior 116" of the spring 26". Also ideally the insert 134 is of a length coinciding with the significant portion of the length of the hollow interior of the spring 26". It will be appreciated that spring 26" and insert 134 cooperatively form an assembly 132 to support the treadmill deck 20".

The purpose of insert 134 is to alter the characteristics of spring assembly 132. To this end, the insert 134 may be formed from material either similar to or dissimilar from the material of which spring 26" is composed. For example, the insert 134 may be formed from material that is harder or softer, less or more elastic, etc. relative to the material of which spring 26 is composed. Also, the insert may be of solid, hollow or partially hollow construction depending on how stiff or flexible it is desired to construct the insert. The particular material composition and construction of insert 134 is selected to cooperate with spring 26" to achieve the desired overall characteristics of spring assembly 132.

In addition to the material from which insert 134 is composed, the overall characteristics of the spring assembly 132 can be altered by changing the extent to which the insert 134 is engaged within the interior of spring 26". As shown in FIG. 7, ideally insert 134 may be selectively engaged within and disengaged from the exterior spring 26" by an actuator system 136. The actuator system 136 is illustrated as including a powered actuator 138 interconnected with the adjacent end wall 140 of the insert 134 through a connecting shaft 142. Actuator 138 may be of various types, for instance, a linear push-pull actuator in the form of a fluid cylinder or a magnetic coil assembly. Alternatively, the actuator 138 may be of a rotary type, for instance, powered by an electrical rotary motor. In this instance, connecting shaft 142 would be in the form of a lead screw to threadably engage end wall 140. The actuator 136 may be remotely operated by the user through control buttons or other interface device located on display panel 41, see FIG. 1.

As further shown in FIG. 7, the insert 134 may be tapered along its length to provide a variable gap 144 between the top of the insert 134 and the underside of the spring 26". By this construction, the spring 26" is deformable downwardly at a particular spring rate, which spring rate will increase when the top wall of spring 26" collapses sufficiently to bear against the top of the insert 134. As would be appreciated, by this construction the spring assembly 132 could initially provide a relatively low level of resistance to the downwardly movement of deck 20" and then provide a relatively higher level of resistance to the further downward movement of the deck once spring 26" has collapsed sufficiently to eliminate gap 144.

Figure 9:
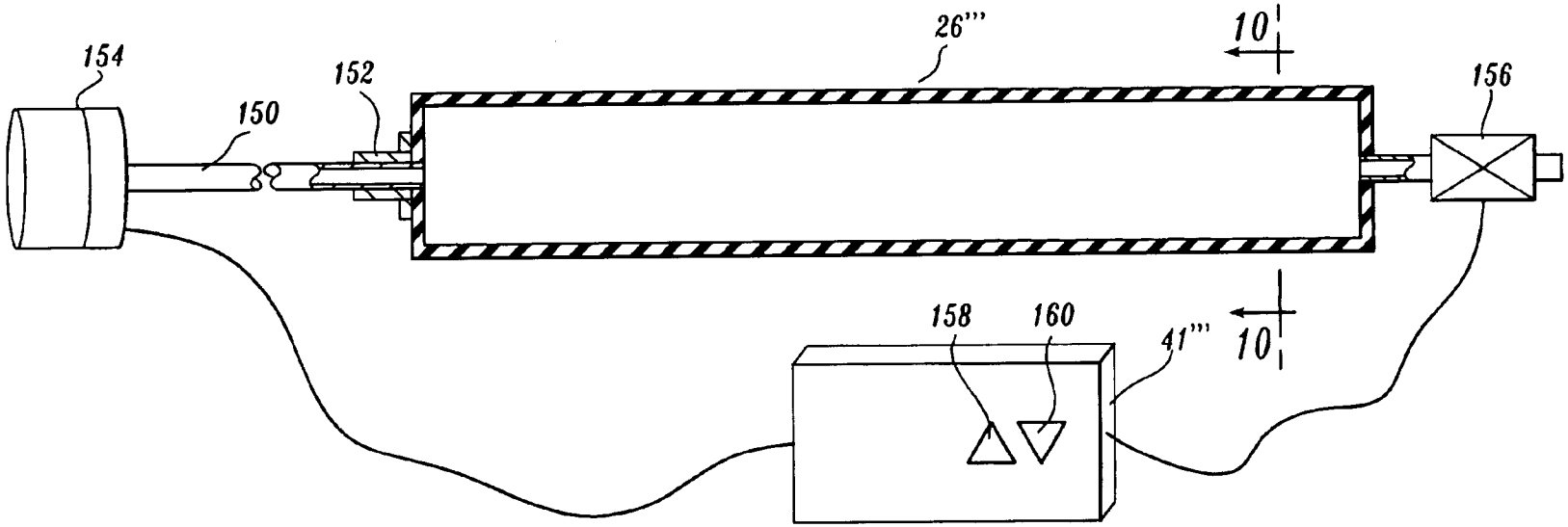
FIG. 9 is an enlarged elevational schematic view of a further preferred embodiment of the present invention.
Figure 10:
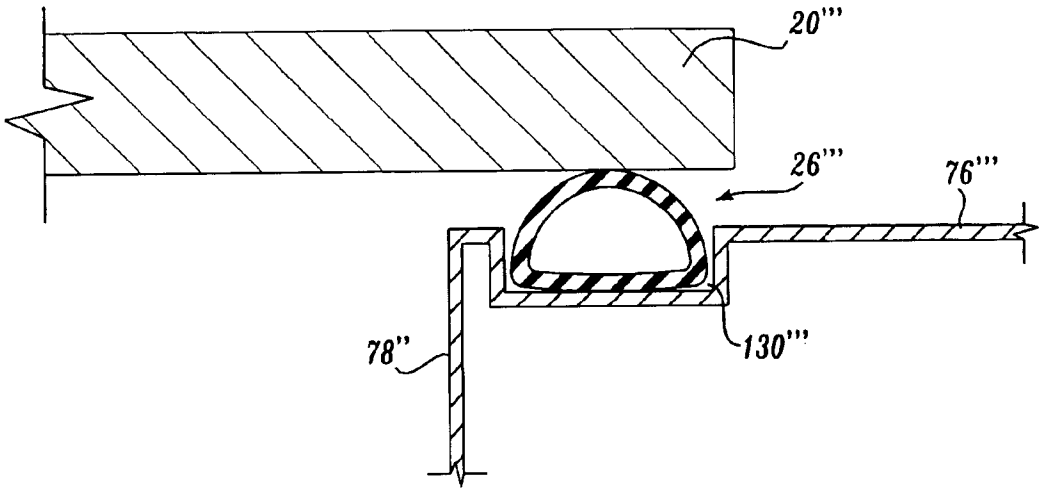
FIG. 10 is a cross-sectional view of FIG. 9 taken substantially along lines 10—10 thereof.
Figure 11:
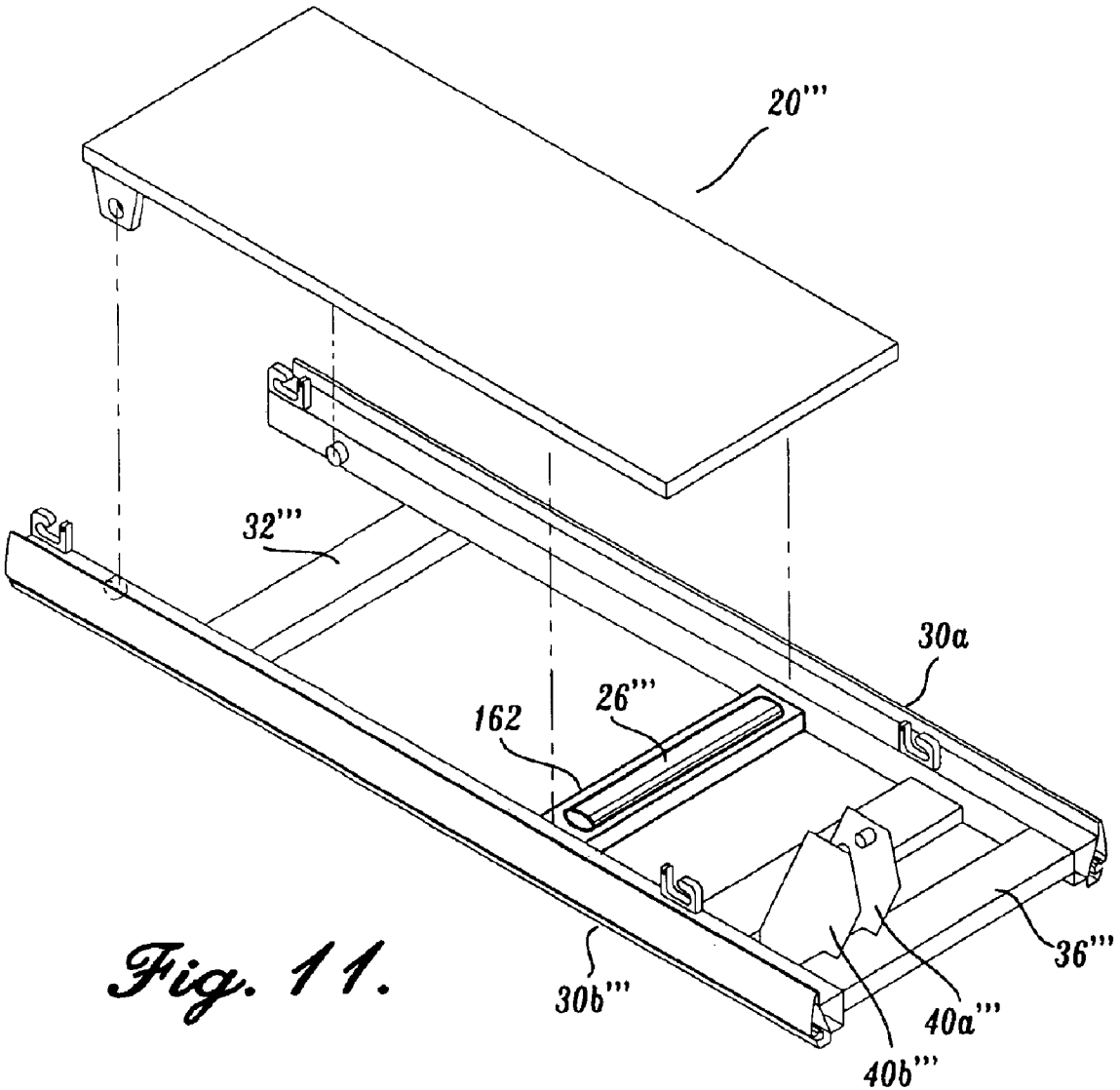
FIG. 11 is an exploded pictorial view of a further preferred embodiment of the present invention.

Another embodiment of the present invention is shown in FIGS. 9–11 wherein a spring 26'" is in the form of a fluid bladder sized to be receivable within an upwardly open channel 130'" formed in upper wall 76'" of the frame rail. As shown in FIG. 9, the bladder 26'" is adapted to bear against the underside of deck 20'" thereby to support the deck. Although the bladder is shown as having a generally oval cross-section, the bladder can be formed in other cross-sectional shapes, such as round, square or rectangular.

A compressible fluid, e.g., air, is supplied to the bladder 26'" through a supply hose 150 connected to an inlet formed in the bladder 26'". If air is used as the compressible fluid, an air compressor 154 may be employed as a supply source. The compressible fluid may be expelled from the bladder 26'" through an outlet valve 156 in fluid flow communication with the bladder. Alternatively, valve 156 may be connected in fluid flow communication with supply hose 150 or incorporated into the construction of compressor 154. As will be appreciated, the "stiffness" of bladder 26'" will be depended on the pressure of the compressible fluid within the bladder, which may be remotely controlled by depressible buttons 158 and 160 located on display panel 41'".

Rather than utilizing two bladders 26'", each mounted on a side rail of the treadmill frame, a single bladder 26'" may be mounted on frame crossmember 162 shown in FIG. 11. This crossmember may be stationary relative to the frame or adapted to be positionable along the length of the frame to alter the location along the length of the deck 20'" supported by the bladder 26'". It will be appreciated that bladder 26'" may be replaced by spring assembly 132 mounted on crossmember 162.

It will be appreciated that by constructing springs 26, 26', 26", 26'" in the elongated configuration as described above and as illustrated in the drawings, and by placing the spring between the frame and the deck, a substantial interface length or area is achieved between the spring and the deck thereby reducing or minimizing bearing or contact stresses, while at the same time requiring very little vertical height, which enables the springs to be readily and conveniently installed. Also, the construction of the springs of the present invention comprise very few components which facilitates their manufacture, assembly, installation, maintenance and reliability.

The present invention has been described above in terms of a preferred embodiment and several variations thereof. It is to be understood that other modifications, alternations and substitutions are possible within the scope of the present invention. It is thus intended that the scope of the Letters Patent granted hereon is to be limited only by the limitations of the appended claims.

The embodiments of the invention in which an exclusive property or privilege is claimed are defined as follows:

1. An exercise treadmill comprising:

(a) an elongate frame;

(b) an endless belt moveably supported by said frame;

(c) a deck disposed between the frame and the upper run of the endless belt, the deck having a first end portion and a second end portion;

(d) a pivot connection acting on the second end portion of the deck to pivot the second end portion of the deck to the frame about an axis extending generally transversely to the length of the frame;

(e) at least one elongated spring extending lengthwise of the frame and disposed between the frame and the deck at a location between the first end portion of the deck and the pivot connection to absorb loads imparted on the deck by the exerciser; and (f) means for repositioning the spring along the length of the frame.

2. The exercise treadmill of claim 1, wherein the spring is disposed between the frame and the underside of the deck.

3. The exercise treadmill of claim 1, wherein the frame includes a pair of laterally spaced apart side rails, and a spring is disposed between each frame side rail and the deck.

4. The exercise treadmill of claim 3, wherein the springs are positioned between the frame side rails and the underside of the deck.

5. The exercise treadmill of claim 4, wherein the springs are disposed lengthwise along the frame side rails.

6. The exercise treadmill of claim 1, wherein the spring provides resistance to the movement of the deck towards the frame under loads imposed by the exerciser in proportion to the extent of movement of the deck towards the frame.

7. The exercise treadmill of claim 1, wherein the spring rate increases with deflection of the spring.

8. The exercise treadmill of claim 7, wherein the spring is comprised of elastomeric material.

9. The exercise treadmill of claim 1, wherein the spring is reversibly deformable under loads imposed on the deck by the exerciser.

10. The exercise treadmill of claim 9, wherein the extent of deformation of the spring per unit load imposed thereon by the deck decreases with increasing loads imposed on the elastomeric spring.

11. The exercise treadmill of claim 10, wherein the spring is composed of elastomeric material.

12. The exercise treadmill of claim 1, wherein the spring includes a longitudinally extending body portion.

13. An exercise treadmill comprising: an elongate frame;

an endless belt moveably supported by said frame;

a deck disposed between the frame and the upper run of the endless belt, the deck having a first end portion and a second end portion;

a pivot connection acting on the second end portion of the deck to pivot the second end portion of the deck to the frame about an axis extending generally transversely to the length of the frame;

at least one elongated spring extending lengthwise of the frame and disposed between the frame and the deck at a location between the first end portion of the deck and the pivot connection to absorb loads imparted an the deck by the exerciser, the spring being movable along the length of the frame to selected locations along the frame; and an actuator for moving the at least one elongated spring lengthwise of the frame, said actuator mounted on the frame and operably connected to the spring.

14. The exercise treadmill of claim 13, wherein the actuator is selected from the group consisting of linear actuators and rotary actuators.

15. The exercise treadmill of claim 13, wherein the actuator is controllable from a location remote from the location of the actuator on the frame.

16. An exercise treadmill comprising:

(a) a frame;

(b) first and second roller assemblies rotatably mounted on the frame;

(c) an endless belt trained around the first and second roller assemblies;

(d) a deck disposed between the frame and the upper run of the endless belt, the deck having a first end portion and a second end portion; and (e) at least one elongated spring assembly disposed to absorb loads imparted on the deck by the exerciser, the spring assembly comprising a first section and a second section selectively engageable with each other, with the extent of engagement being alterable to thereby alter the spring rate of the spring assembly.

17. The exercise treadmill of claim 16, wherein the first spring assembly section is sized and shaped to receive the second spring assembly section therein, the first spring assembly having a body portion that is at least partially hollow for receiving the second spring assembly section therein.

18. The exercise treadmill of claim 16, wherein the second spring assembly section in cross-sectional shape generally corresponds to the cross-sectional shape of the hollow body portion of the first spring assembly section.

19. The exercise treadmill of claim 18, wherein the second spring assembly section is tapered along its length.

20. The exercise treadmill of claim 18, wherein the second spring assembly section is telescopically engageable within the first spring assembly section.

21. The exercise treadmill of claim 16, wherein the second spring assembly section is tapered along its length.

22. The exercise treadmill of claim 16, further comprising an actuator operably connected to the spring assembly for altering the extent of engagement of the spring assembly first section with the spring assembly second section, the actuator operating on one or both of the first and second spring assembly sections.

23. The exercise treadmill of claim 22, wherein the actuator is selected from the group consisting of linear actuators and rotary actuators.

24. The exercise treadmill of claim 16, wherein the first spring assembly section is composed of elastomeric material.

25. The exercise treadmill of claim 16, wherein the exterior of the second spring assembly section is shaped to generally correspond to the shape of the interior of the first spring assembly section.

26. The exercise treadmill of claim 25, wherein the second spring assembly section is telescopically engageable within the first spring assembly section.

27. The exercise treadmill of claim 13, wherein the spring is disposed between the frame and the underside of the deck.

28. The exercise treadmill of claim 13, wherein the frame includes a pair of laterally spaced apart side rails, and a spring is disposed between each frame side rail and the deck.

29. The exercise treadmill of claim 28, wherein the springs are positioned between the frame side rails and the underside of the deck.

30. The exercise treadmill of claim 29, wherein the springs are disposed lengthwise along the frame side rails.

31. The exercise treadmill of claim 13, wherein the spring provides resistance to the movement of the deck towards the frame under loads imposed by the exerciser in proportion to the extent of movement of the deck towards the frame.

32. The exercise treadmill of claim 13, wherein the spring rate increases with deflection of the spring.

33. The exercise treadmill of claim 32, wherein the spring is comprised of elastomeric material.

34. The exercise treadmill of claim 13, wherein the spring is reversibly deformable under loads imposed on the deck by the exerciser.

35. The exercise treadmill of claim 34, wherein the extent of deformation of the spring per unit load imposed thereon by the deck decreases with increasing loads imposed on the elastomeric spring.

36. The exercise treadmill of claim 35, wherein the spring is composed of elastomeric material.

37. The exercise treadmill of claim 13, wherein the spring includes a longitudinally extending body portion.

* * * * *